US008109860B2

(12) United States Patent
Lo

(10) Patent No.: US 8,109,860 B2
(45) Date of Patent: Feb. 7, 2012

(54) TWISTING AND LEAPING EXERCISE APPARATUS

(75) Inventor: Ming-An Lo, Pingzhen (TW)

(73) Assignee: Ping-Yu Liu, Taipei (TW)

( * ) Notice: Subject to any disclaimer, the term of this patent is extended or adjusted under 35 U.S.C. 154(b) by 8 days.

(21) Appl. No.: 12/727,949

(22) Filed: Mar. 19, 2010

(65) Prior Publication Data

US 2010/0248923 A1 Sep. 30, 2010

(30) Foreign Application Priority Data

Mar. 26, 2009 (TW) ..... 98204789 U

(51) Int. Cl.

| | |
|---|---|
| ***A63B 5/00*** | (2006.01) |
| ***A63B 5/08*** | (2006.01) |
| ***A63B 22/04*** | (2006.01) |
| ***A63B 22/14*** | (2006.01) |

(52) U.S. Cl. ..... 482/51; 482/26; 482/52; 482/77; 482/123; 482/146

(58) Field of Classification Search ..... 482/51, 482/52, 15, 26, 31, 74, 77, 146, 147, 123, 482/125, 126

See application file for complete search history.

(56) References Cited

U.S. PATENT DOCUMENTS

| | | | | |
|---|---|---|---|---|
| 3,511,500 | A * | 5/1970 | Dunn | 482/113 |
| 3,612,519 | A * | 10/1971 | Larson | 482/147 |
| 5,807,210 | A * | 9/1998 | Devlin | 482/52 |
| 6,068,577 | A * | 5/2000 | Lo | 482/52 |
| 6,899,657 | B2 * | 5/2005 | Chuang | 482/52 |
| 6,921,353 | B2 * | 7/2005 | Chuang | 482/52 |
| 6,997,854 | B2 * | 2/2006 | Yang | 482/53 |
| 7,614,990 | B2 * | 11/2009 | Baek | 482/146 |
| 7,878,960 | B1 * | 2/2011 | Liu | 482/146 |

FOREIGN PATENT DOCUMENTS

WO WO 2010066155 A1 * 6/2010

* cited by examiner

*Primary Examiner* — Loan Thanh
*Assistant Examiner* — Victor K Hwang
(74) *Attorney, Agent, or Firm* — Muncy, Geissler, Olds & Lowe, PLLC

(57) ABSTRACT

A twisting and leaping exercise apparatus includes a base, at least one fixed seat, one or more sets of upper and lower swinging arms, a pedal set, a connecting plate and an elastic module. If an exerciser applies a force onto the pedal set, the pedal set will press onto the elastic module, such that the restoring resilience of the elastic module allows the exerciser to have an up-and-down leaping exercise, and the exerciser can also turn the pedal set to left and right to achieve the function of a waist twisting exercise, so as to achieve an all-round exercise and a better exercise effect.

11 Claims, 8 Drawing Sheets

TWISTING AND LEAPING EXERCISE APPARATUS

BACKGROUND OF THE INVENTION

1. Field of the Invention

The present invention relates to a design of a twisting and leaping exercise apparatus, and more particularly to a twisting and leaping exercise apparatus that provides up-and-down leaping and left-and-right twisting exercise effects to users to achieve an all-round exercise effect.

2. Description of the Related Art

Various fitness equipments are designed with different functional structures according to their use to fit users' operating requirements, so as to achieve different fitness effects. Since fitness equipments can be operated and used anytime conveniently, they become increasingly popular and extensively used by consumers.

Among these fitness equipments, the most popular one used at home is a stepper. Since the stepper has a light weight and an easy-to-store feature and provides a mild exercise, therefore the stepper is suitable for exercises of the whole family. The design of a conventional stepper simulates human walking movements, and thus its operation can provide the exercise effect similar to walking and strolling. Although the conventional stepper can provide sufficient exercise for users, yet it cannot provide the benefits of an exercise other than walking (since users can obtain their desired exercise capacity by walking continuously and exercise their muscles similar to walking), and thus the exercise effect of the stepper cannot be enhanced up to the level of providing a good relaxing exercise effect for muscles of the whole body.

In view of the shortcomings of the conventional stepper having a structural function of simulating human walking, increasing exercise capacity of leg muscles without taking the all-round exercise effect for other muscles into consideration, the inventor of the present invention based on years of experience in the related industry to conduct extensive researches and experiments, and finally developed a twisting and leaping exercise apparatus to overcome the shortcomings of the prior art.

SUMMARY OF THE INVENTION

Therefore, it is a primary objective of the present invention to provide a twisting and leaping exercise apparatus using a simple structure to provide an up-and-down leaping exercise effect to users and achieve an all-round exercise effect and reducing the manufacturing cost to improve the product competitiveness. In addition, the present invention includes an elastic module for damping the downward impact forces caused by the body weight of the users.

To achieve the foregoing objective, the present invention discloses a twisting and leaping exercise apparatus comprising a base, at least one fixed seat, one or more sets of upper and lower swinging arms, a pedal set, a connecting plate and an elastic module, wherein the fixed seat is installed on the base, and an end of the upper and lower swinging arms is pivotally installed onto the fixed seat, and another end is coupled to a pedal, and the pedal set is installed at an end of the upper and lower swinging arms by a connecting plate, and the elastic module is coupled to the pedal set for providing an elasticity for up and down movements of the pedal set, such that when an exerciser applies forces to the pedal set, the pedal set presses onto the elastic module, and the restoring resilience provided by the elastic module allows users to leap up and down. In addition to the up and down leaping movements, the pedal set also can be turned to left and right to provide the function of a waist twisting exercise, so as to achieve an all-round exercise function and a better exercise effect.

DETAILED DESCRIPTION OF THE PREFERRED EMBODIMENTS

The structural assembly, overall operation and technical characteristics of the present invention will become apparent with the detailed description of the preferred embodiments and the illustration of the related drawings as follows.

Figure 1:
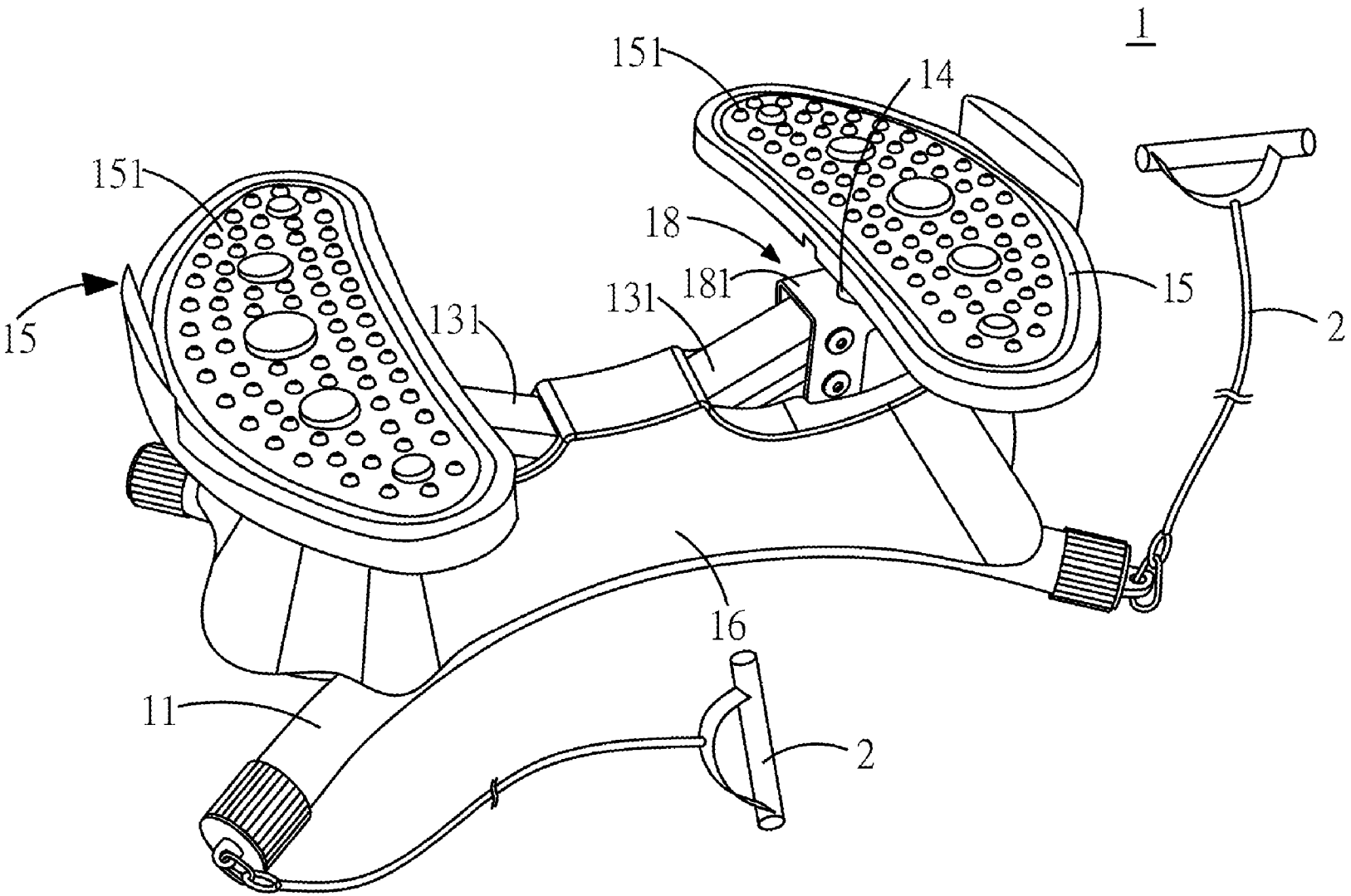
FIG. 1 is a perspective view of a twisting and leaping exercise apparatus in accordance with a first preferred embodiment of the present invention.
Figure 2:
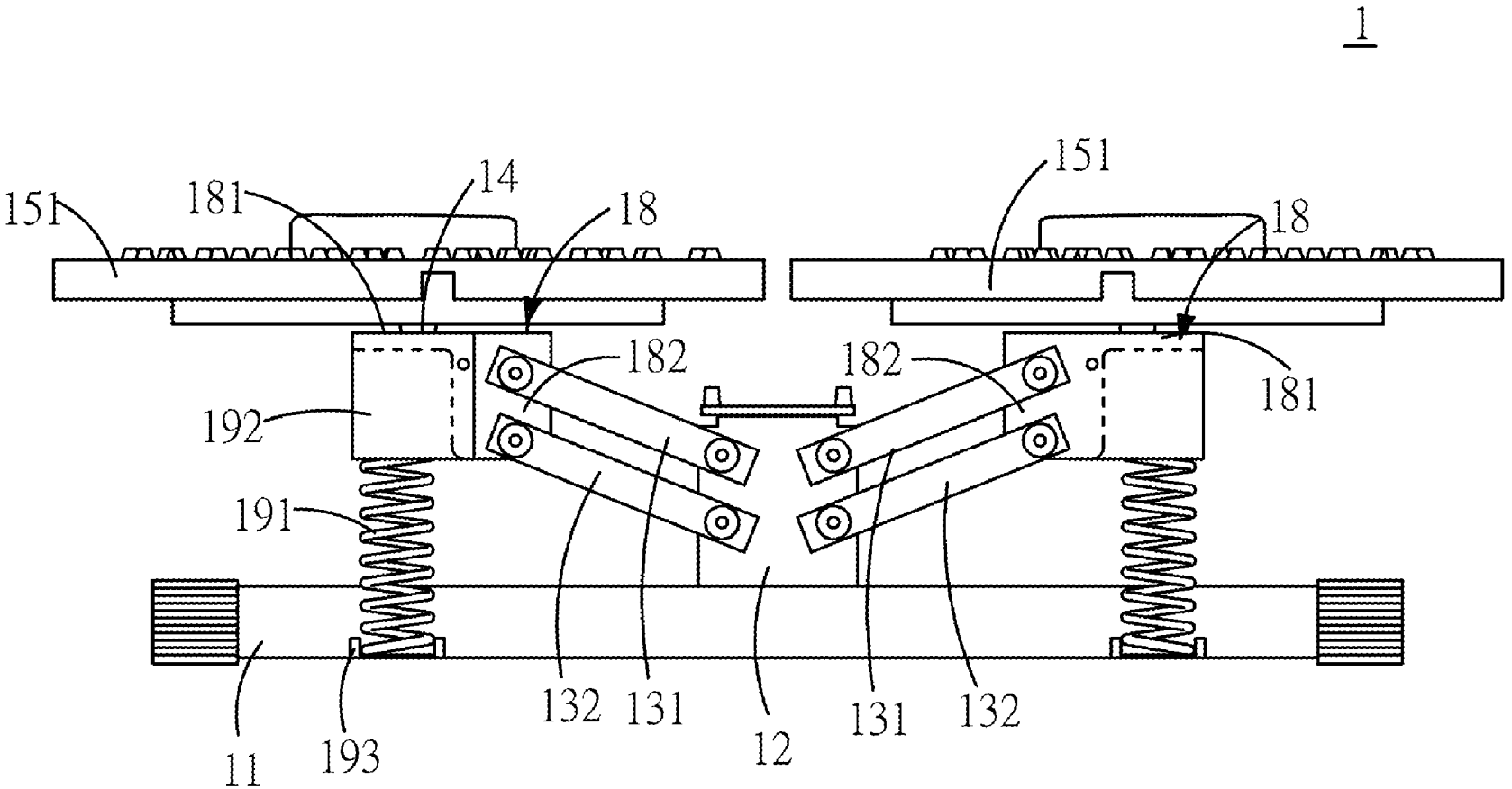
FIG. 2 is a schematic view of a twisting and leaping exercise apparatus in accordance with a first preferred embodiment of the present invention.
Figure 3:
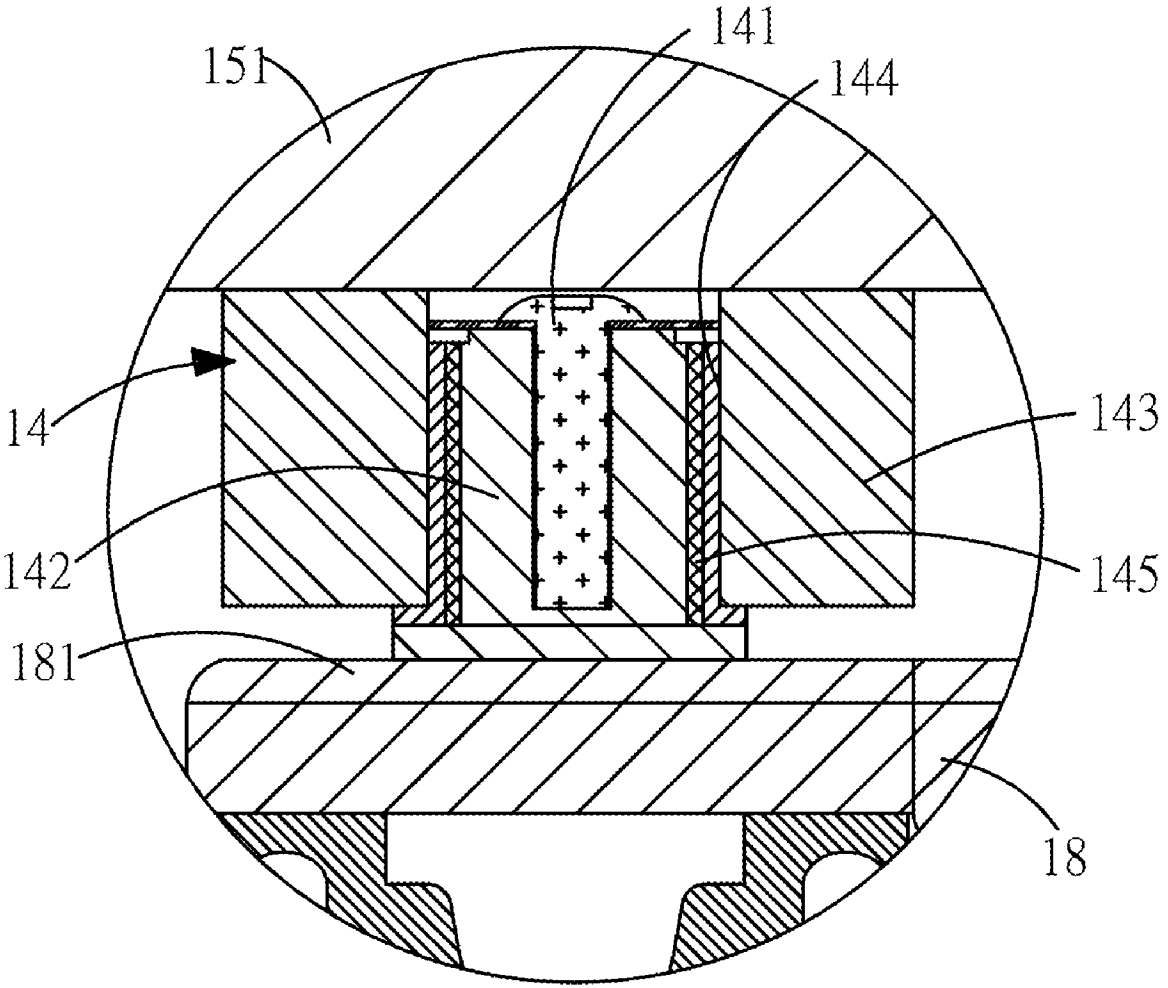
FIG. 3 is a schematic view of a shaft module of the present invention.

With reference to FIGS. 1 and 2 for a twisting and leaping exercise apparatus in accordance with a first preferred embodiment of the present invention, the twisting and leaping exercise apparatus 1 comprises:

a base 11;

at least one fixed seat 12, installed onto the base 11;

one or more sets of upper and lower swinging arms 131, 132, wherein there are two sets of upper and lower swinging arms 131, 132 in this embodiment, and an end of the upper and lower swinging arms 131, 132 is pivotally installed to the fixed seat 12, and another end is coupled to a pedal set 15, and the upper and lower swinging arms 131, 132, are arranged into upper and lower positions respectively;

a pedal set 15, installed at an end of the upper and lower swinging arms 131, 132, and having two rotating pedals 151;

a connecting plate 18, having a planar portion 181 and a pivot portion 182 substantially parallel to a floor, and the pedal set 15 being installed to the planar portion 181 by a shaft module 14 and pivotally coupled to an end of the upper and lower swinging arms 131, 132 by a pivot portion 182;

a shaft module 14, installed between the pedal set 15 and the connecting plate 18, and the shaft module 14 as shown in FIG. 3 comprising a fixing element 141, a shaft 142 and a connecting pipe 143, and the shaft 142 being fixed to the planar portion 181 of the connecting plate, and the connecting pipe 143 being fixed below each rotating pedal 151 of the pedal set, and the connecting pipe 143 including a sheath hole 144 for sheathing the shaft 142, and at least one shaft sleeve 145 being installed between an internal wall of the sheath hole 144 and the shaft 142 and made by a powder metallurgy process, and the fixing element 141 (which can be a screw) being installed for connecting the shaft 142 and the connecting pipe 143, such that each rotating pedal 151 of the pedal set can be turned on the connecting plate 18 by using the shaft module 14 as an axial center;

at least one elastic module 191, which can be a spring or a rubber, coupled to the pedal set 15, for providing an elasticity for up and down movements of the pedal set 15, wherein the elastic module (or spring) 191 can be installed below the pedal set 15, and the elastic module 191 includes a fender 192 installed on an external side of the elastic module 191 and fixed to the connecting plate 18; and a guide plate 16, installed onto the base 11, for sheltering the fixed seat 12 and the elastic module 191.

Figure 4:
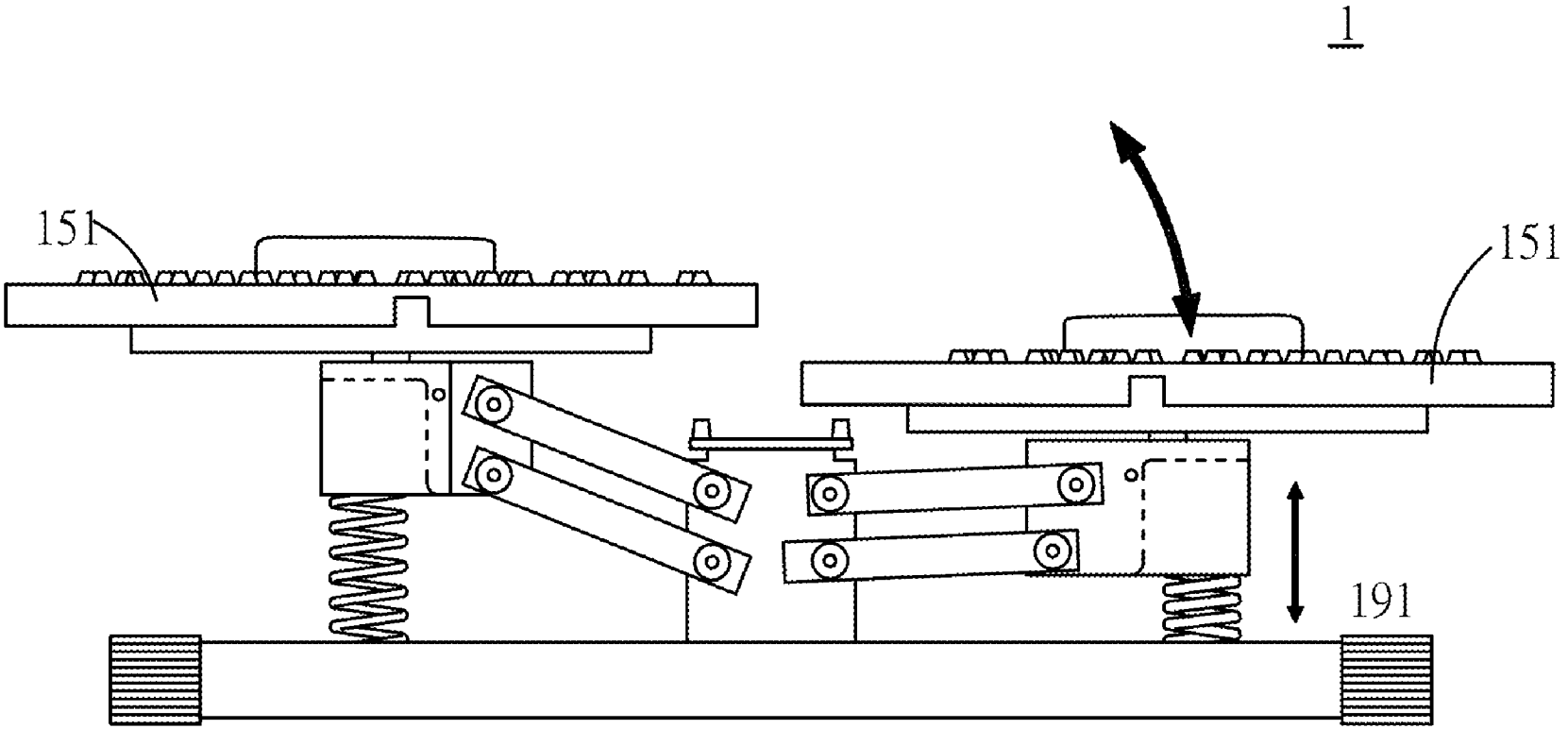
FIG. 4 is a schematic view of up-and-down leaping movements of a twisting and leaping exercise apparatus in accordance with the present invention.
Figure 5:
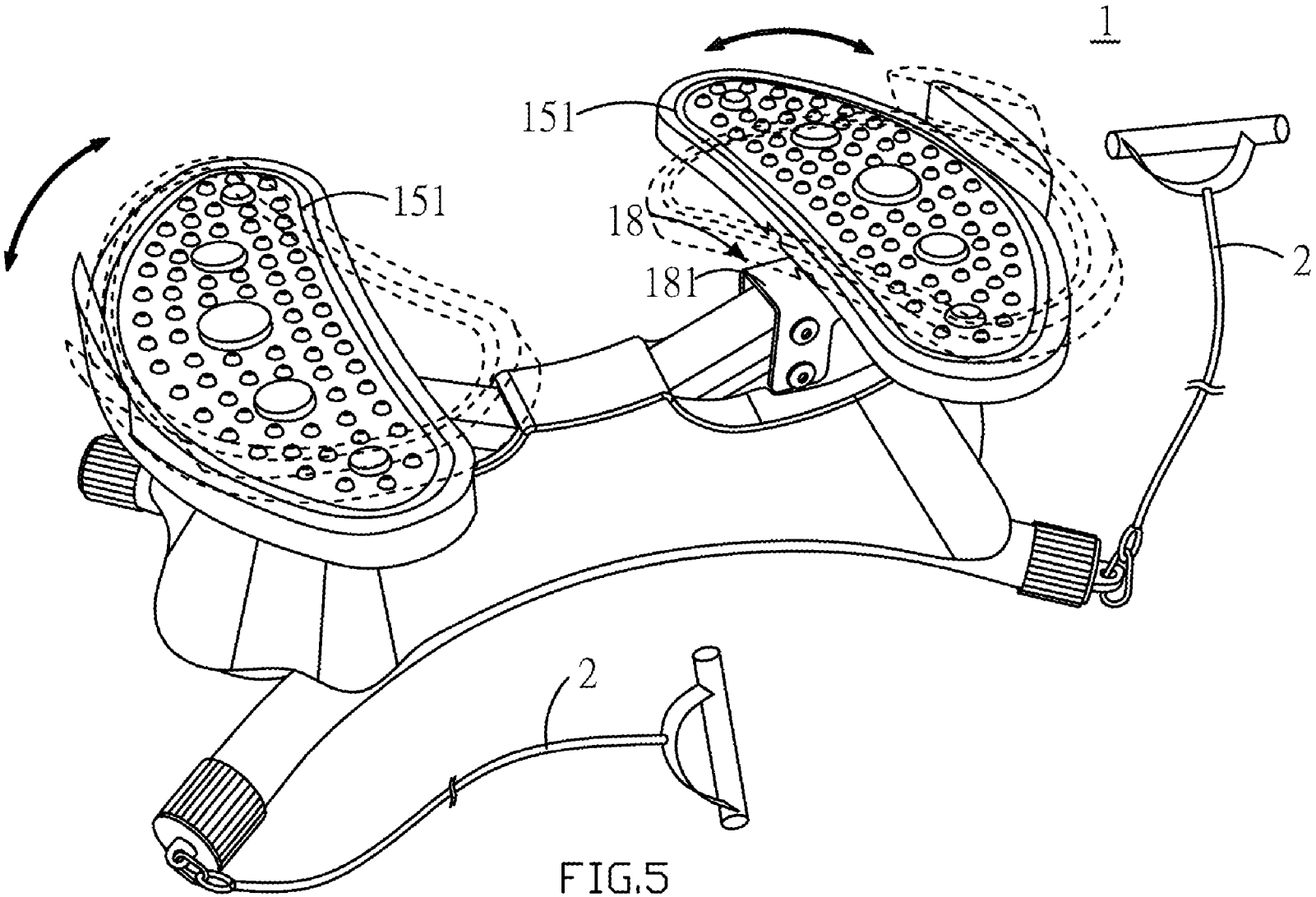
FIG. 5 is a schematic view of left-and-right twisting movements of a twisting and leaping exercise apparatus in accordance with the present invention.

When use, a user can stand on the rotating pedals 151 with each leg on each rotating pedal 151 as shown in FIGS. 4 and 5, and the user not just can obtain the up-and-down leaping exercise effect from the twisting and leaping exercise apparatus only, but also can turn each rotating pedal 151 of the pedal set to left and right to achieve the waist twisting exercise effect. Of course, the twisting and leaping exercise apparatus can further comprise a pull rope 2 with an end fixed to the base 11, such that the user can use the twisting and leaping exercise apparatus 1 for leg exercises as well as arm exercises by pulling the pull rope 2.

Figure 6A:
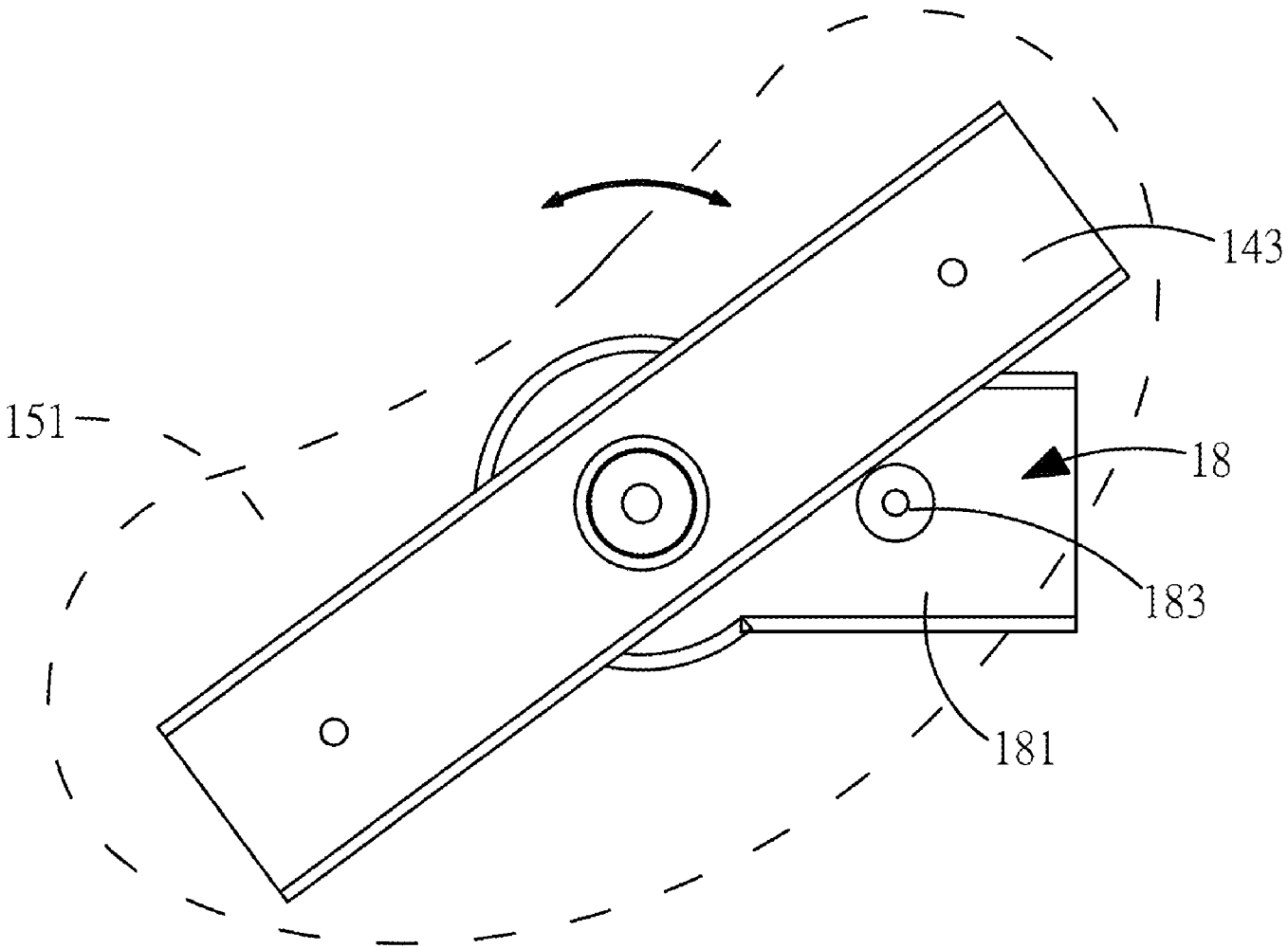
FIGS. 6A and 6B are schematic views of a rotating pedal with a limited rotating angle in accordance with the present invention.
Figure 6B:
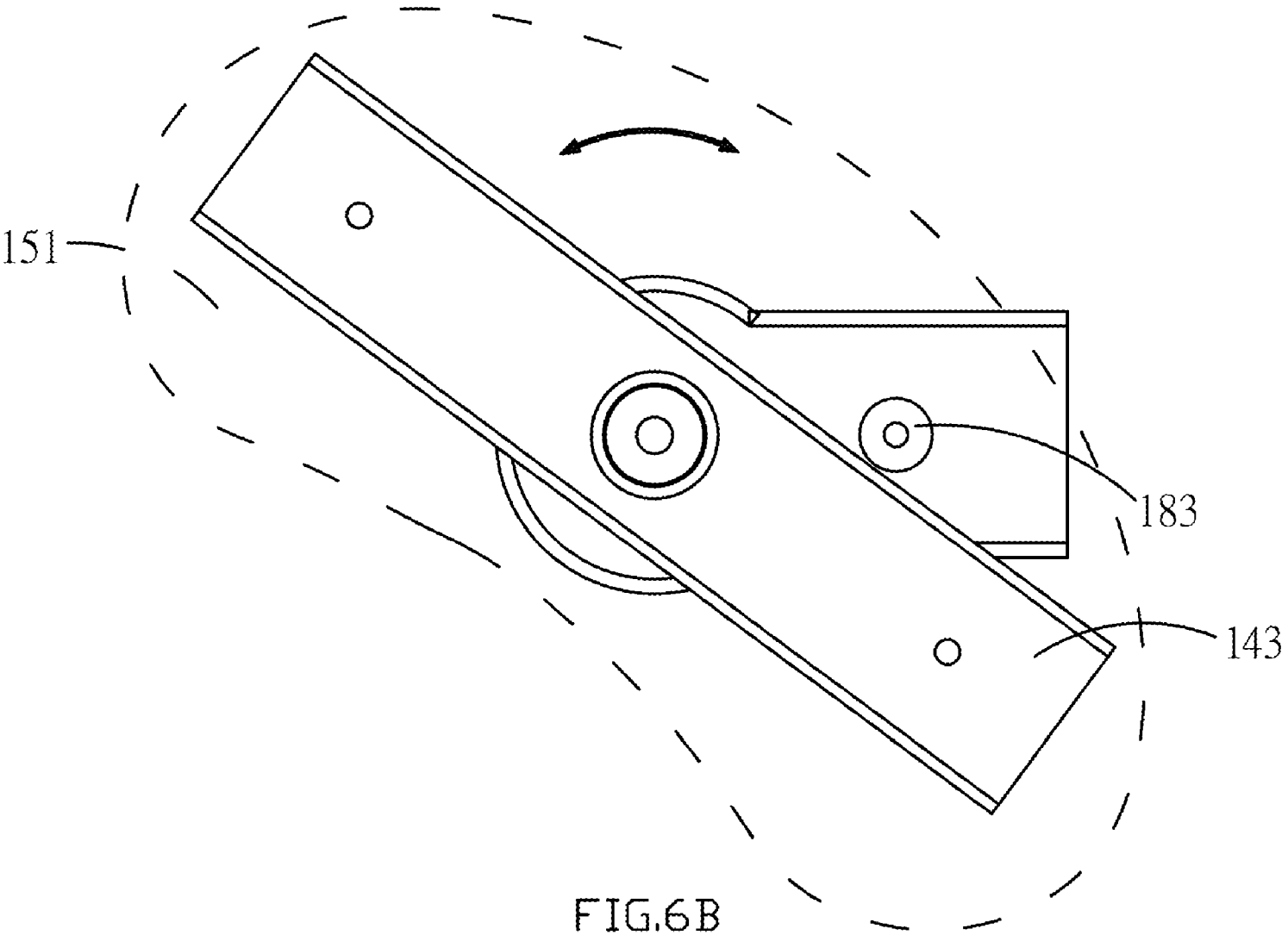

With reference to FIGS. 6A and 6B, the planar portion 181 of the connecting plate further includes a position-limit stopper 183 with a protruding surface for limiting a rotating angle of the pedal set each rotating pedal 151.

Figure 7:
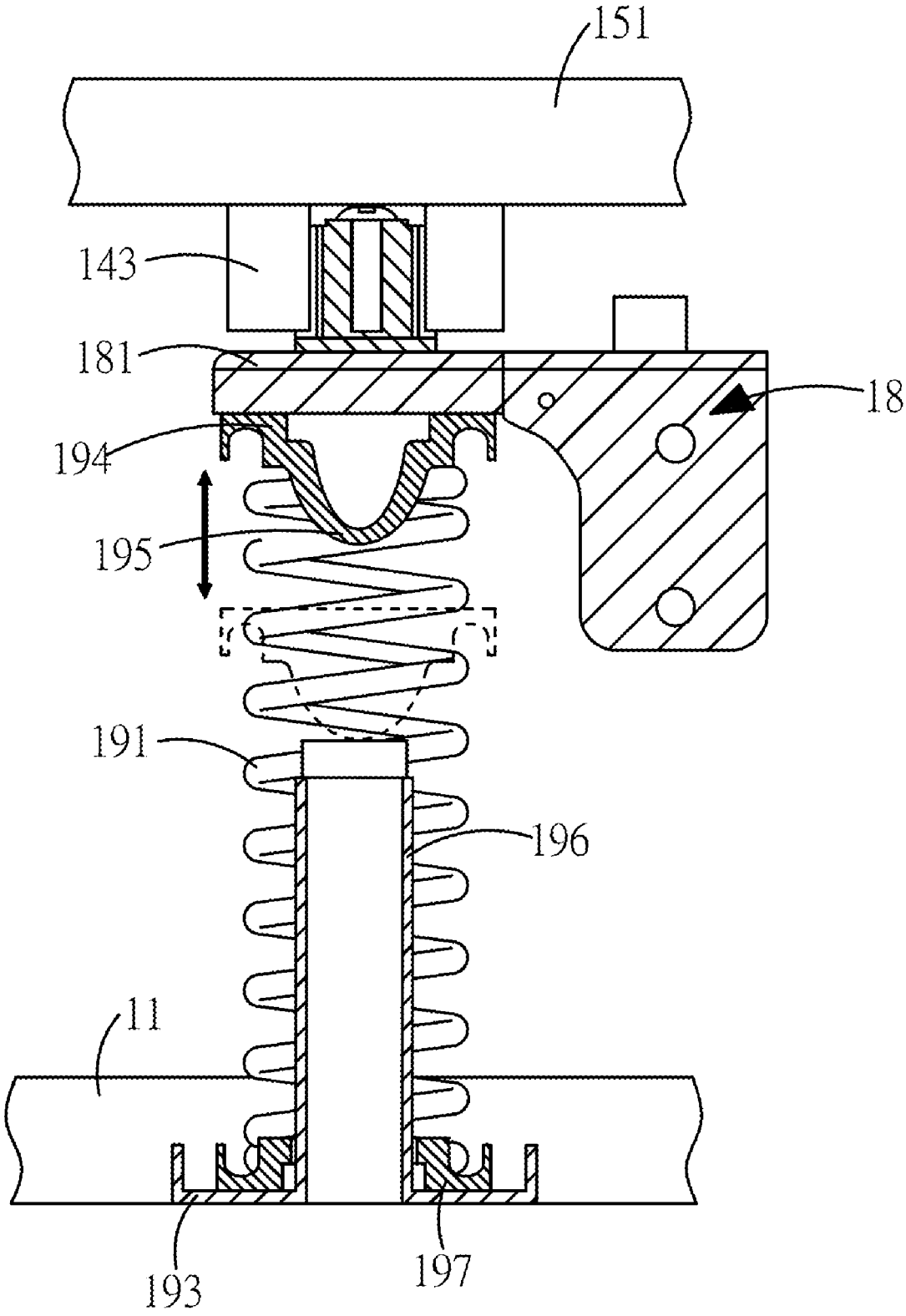
FIG. 7 is a schematic view of an elastic module of the present invention.

In FIGS. 2 and 7, the base 11 includes a position-limit seat 193 installed at the bottom of the base 11 and provided for installing the elastic module 191, such that the elastic module 191 will be fixed at a position, and an upper shock absorbing rubber 194 is installed below each rotating pedal 151 of the twisting pedal and extended into a protrusion 195 of the elastic module 191, and the position-limit seat 193 includes a protruded pillar 196 extended into the elastic module 191, and the position-limit seat 193 includes a lower shock absorbing rubber 197 installed at a position corresponding to the elastic module 191, so that an interval between the protrusion 195 and the protruded pillar 196 can be controlled by the elasticity of the elastic module 191.

It is noteworthy to point out that the present invention improves over the prior art that provides an exercise effect by simulating human walking, but cannot increase the exercise capacity. On the other hand, the twisting and leaping exercise apparatus of the present invention can provide users the up-and-down leaping exercise effect as well as the left-and-right twisting exercise effect, so that the invention not just provides an exercise for all muscles of the user's body and improve the exercise capacity effectively, but also increases the user's energy consumption.

The present invention complies with patent application requirements, and is thus duly filed for the patent application. While the invention has been described by device of specific embodiments, numerous modifications and variations could be made thereto by those generally skilled in the art without departing from the scope and spirit of the invention set forth in the claims.

What is claimed is:

1. A twisting and leaping exercise apparatus, comprising:

a base;

at least one fixed seat, installed onto the base;

two sets of upper and lower swinging arms, each having an end pivotally installed to the fixed seat and an opposite end coupled to one of two pedal sets wherein the respective ends of the two sets of upper and lower swinging arms are pivotally installed at different positions on the fixed seat and the two pedal sets are installed at the opposite ends of the upper and lower swinging arms, respectively;

two connecting plates, each having a planar portion substantially parallel to a floor, and a pivot portion, and each of the pedal sets being installed on the planar portion by a shaft module, and pivotally installed at the opposite end of the upper and lower swinging arms by the pivot portion;

a shaft being installed between each pedal set and respective connecting plate, such that the pedal set can be rotated on the connecting plate about the shaft module as an axial center wherein the respective planar portions of the connecting plates each further include a position-limit stopper having a protruding surface for limiting a rotating angle of the pedal set;

two elastic modules, each being mounted between the base and the respective connecting plate, and installed below the pedal sets, for providing a biasing force against an upward or a downward movement of the pedal set.

2. The twisting and leaping exercise apparatus of claim 1, wherein the shaft module comprises:

a fixing element;

the shaft, fixed to the planar portion of the respective connecting plate;

a connecting pipe, fixed below the pedal set, and including a sheath hole for sheathing the shaft, and the fixing element being used for coupling the shaft and the connecting pipe.

3. The twisting and leaping exercise apparatus of claim 2, further comprising at least one shaft sleeve disposed between an internal wall of the sheath hole and the shaft.

4. The twisting and leaping exercise apparatus of claim 1, further comprising a guide plate installed on the base for sheltering the fixed seat and the elastic modules.

5. The twisting and leaping exercise apparatus of claim 1, wherein the base includes position-limit seats disposed at the bottom of the base, for installing the respective elastic module on the position-limit seat, and fixing the elastic module at a position.

6. The twisting and leaping exercise apparatus of claim 5, wherein the elastic module is a spring or a rubber.

7. The twisting and leaping exercise apparatus of claim 5, wherein each pedal set includes an upper shock absorbing rubber installed on the pedal set, and the upper shock absorbing rubber has a protrusion extended into the respective elastic module, and the position-limit seat has a protruded pillar extended into the respective elastic module, such that an interval between the protrusion and the protruded pillar can control an elasticity of the elastic module.

8. The twisting and leaping exercise apparatus of claim 5, wherein each position-limit seat includes a shock absorbing rubber installed at a position corresponding to the respective elastic module.

9. The twisting and leaping exercise apparatus of claim 1, wherein each elastic module further includes a fender installed on an external side of the elastic module.

10. The twisting and leaping exercise apparatus of claim 9, wherein each fender is fixed to the respective connecting plate.

11. The twisting and leaping exercise apparatus of claim 1, further comprising a pull rope with an end fixed to the base.

* * * * *